United States Patent [19]

Middel

[11] 4,290,764

[45] Sep. 22, 1981

[54] METHOD AND APPARATUS FOR FOLDING A CARDBOARD SHEET ALONG A STRAIGHT FOLD LINE

[75] Inventor: Jan Middel, Ijmuiden, Netherlands

[73] Assignee: Hoogovens Ijmuiden, B.V., Ijmuiden, Netherlands

[21] Appl. No.: 49,039

[22] Filed: Jun. 15, 1979

[30] Foreign Application Priority Data

Jun. 21, 1978 [NL] Netherlands ..... 7806683

[51] Int. Cl.[3] ..... B65H 45/00; B65H 45/14

[52] U.S. Cl. ..... 493/395; 493/419

[58] Field of Search ..... 270/68 R, 80, 61 R; 93/39 R, 40, 41, 47, 48, 49, 84 R, 1 R; 162/196, 271; 72/215–217; 493/395–404

[56] References Cited

U.S. PATENT DOCUMENTS

| | | | |
|---|---|---|---|
| 3,009,179 | 11/1961 | Schramm | 93/1 R |
| 3,387,841 | 6/1968 | Menell | 270/80 |
| 4,153,240 | 5/1979 | Gouley | 270/68 R |

*Primary Examiner*—Edgar S. Burr
*Assistant Examiner*—A. Heinz
*Attorney, Agent, or Firm*—Stevens, Davis, Miller & Mosher

[57] ABSTRACT

The problem of loss of strength in carboard along a line of fold due to stretching and breaking of fibres on the outside of the fold is overcome by providing a machine having a support surface against which the sheet of cardboard which is to be folded is held by an element which has a knife edge. The support surface is provided by a taut flexible sheet material which extends around a rotatable and movable roller. On operation of the machine, the roller is moved around the knife edge, its longitudinal axis being kept parallel to the knife edge, thereby making a fold in the sheet and the cardboard. The flexible sheet which contacts the cardboard has a high coefficient of friction with respect to cardboard. The restrains the cardboard fibres on the outerside of the cardboard as the fold is made preventing their stretching and breaking and thereby providing an unweakened fold.

9 Claims, 9 Drawing Figures

METHOD AND APPARATUS FOR FOLDING A CARDBOARD SHEET ALONG A STRAIGHT FOLD LINE

BACKGROUND OF THE INVENTION

1. Field of the Invention

This invention relates to method and apparatus for folding a cardboard sheet along a straight fold line, and to a cardboard sheet folded by the method. Cardboard is also known as paperboard, but the former term will be used in this specification and claims.

2. Description of the Prior Art

In one known method of folding a cardboard sheet, a first surface of the sheet is located against a first element having a straight edge at the location where fold line is to be formed, the second surface of the cardboard sheet is located against a support surface and a second element pushed the second surface of the cardboard sheet so as to fold the sheet around the said edge, thereby forming the fold line in the sheet at said edge. Illustrative disclosures of this known process as in U.S. Pat. Nos. 2,283,159, 2,477,355, German Pat. No. 555,202 and Dutch published Pat. application No. 7,705,944.

This known process suffers from a major defect. When the cardboard sheet is folded around an edge, the fibres of the board on the outside of the fold are stretched and rupture, so that the cardboard loses strength considerably along the fold line.

SUMMARY OF THE INVENTION

The object of the present invention is to provide method and apparatus for folding cardboard in which this defect is avoided, so that folded cardboard sheets which are relatively unimpaired in strength at the fold line can be produced.

The method of the invention is characterized in that, in the known method generally described above, the said support surface is provided by a tensioned flexible web which is pressed by the said second element against the second surface of the cardboard sheet at least at the region of the fold line and is folded around the said edge of the first element together with the sheet, the said web making high-friction contact with the cardboard so that in the folding it grips the second surface of the sheet against the fold line.

The apparatus of the invention for folding a sheet of cardboard along a straight fold line, has a first element having a straight edge adapted to define the fold line, a support surface for the cardboard sheet and a second element movable in a path close to said straight edge of the first element so as, in operation, to fold a cardboard sheet located between the first element and the support surface around the said straight edge in order to form the fold line in the cardboard sheet this apparatus is characterized in that said support surface is provided by a flexible web maintained under tension and lying between said second element and said first element so as to be folded around said edge of the first element together with the cardboard sheet in a folding operation, the surface of said web which in use engages the cardboard having a high coefficient of friction with respect to cardboard.

The invention is founded on the idea that, if rupture of the fibres at the outside of the fold is to be avoided, the fibres at the inside of the fold must be crushed together while the fibres at the outside are held in position relative to each other. To this end, the tensioned flexible web is provided which makes high-friction contact with the outside surface of the cardboard at the fold, thereby gripping this surface of the cardboard and preventing its rupture during folding. The cardboard should not slide relative to this web.

In a preferred form of the invention, the web is tensioned and held in position conveniently if the said second element is a cylindrical roller rotatable abouts its central axis which is parallel to the fold line, the web being wrapped around this roller and tensioned by means urging the roller in rotation about its axis. The roller is preferably rotatable about an axis located substantially at the fold line in order to cause the folding.

BRIEF INTRODUCTION OF THE DRAWINGS

The invention will now be diagrammatically illustrated, and the preferred but non-limitative embodiment described, by reference to the accompanying drawings, in which:

FIG. 6 is a side view of a machine for folding cardboard embodying the invention, while

Figure 1:
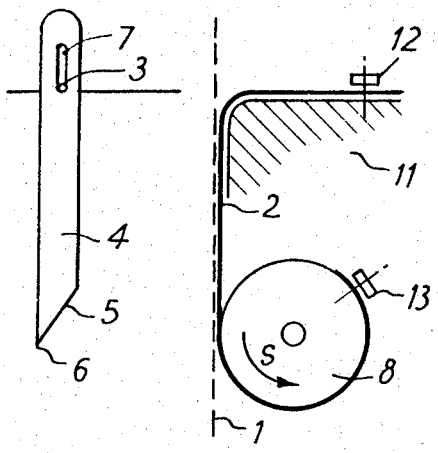
FIGS. 1, 2, 3 and 4 show schematically successive stages of folding a sheet of cardboard along a line by the method of the invention.

Referring first to FIGS. 1 to 4, a sheet of cardboard which is to be folded is represented by the broken line 1. The machine includes flexible web 2 providing a support surface for the cardboard, a pressing element 4, a knife edge 6 of the pressing member 4 and a folding element 8, all shown in diagrammatic cross-section. The folding element 8 is a cylindrical roller having its central axis parallel to the knife edge 6, and movable around an eccentric axis as described below. The web 2 is a sheet of flexible material which has, at least on the side adjacent the cardboard sheet a high coefficient of friction with respect to cardboard being, for example, canvas. This sheet extends from a support 11 to the cylinder 8 being secured at 12, 13 respectively. The cylinder 8 is rotatable about its central axis in the direction of the arrow S and is urged to rotate thus by means (not shown), in this way keeping the sheet material 2 in a tensioned or taut condition. The pressing element 4 is an elongate bar pivoted about a pivot 3 which extends through a slot 7. The element 4 has a smooth surface 5 opposed to the web 2.

Figure 2:
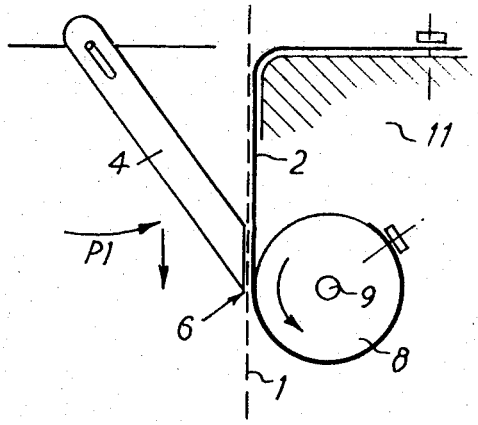

As shown in FIG. 1, the sheet of cardboard which is to be folded is placed against the web 2. The pressing element 4 is then swung in the direction of arrows P1, as shown in FIG. 2, by means which for the sake of clarity are not shown here, so that the surface 5 holds the cardboard 1 against the web 2. The knife edge 6 is now exactly adjacent the intended line of fold in the cardboard 1 adjacent the transition between the planar part of the web 2 and the circumference of the cylinder 8.

Figure 3:
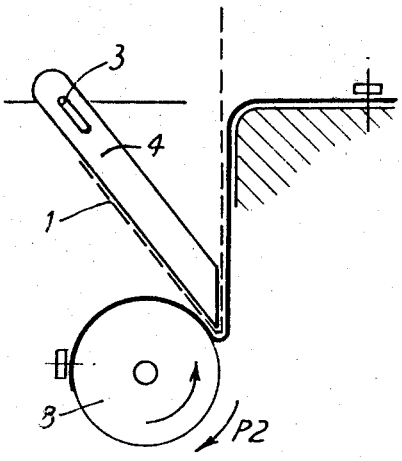

The cylinder 8 can now be moved, e.g. by means of drive cylinders incorporating rotary motion (not shown) around an axis substantially at the knife edge following the arrow P2 shown in FIG. 3. During this motion the central axis of the cylinder 8 is kept parallel to the knife edge 6 and its surface, covered by the flexible web 2 is kept in contact with the cardboard which is thus drawn and folded around the knife edge 6 to make the fold 10.

Figure 4:
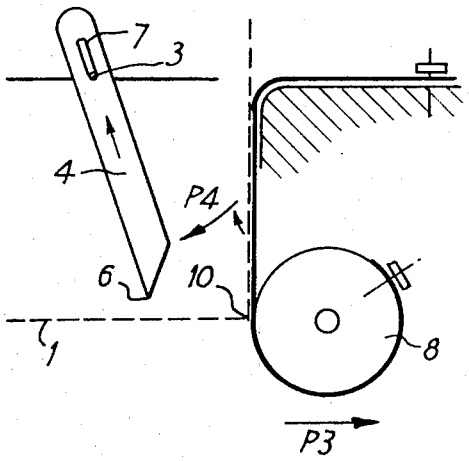

The fold 10 around the knife edge 6 is made at an acute angle as shown in FIG. 3 but on return movement of the cylinder 8 in the direction of the arrow P3 as shown in FIG. 4 and of the element 4 in the direction of the arrows P4, the fold 10 in the cardboard is kept at 90°. In the return movement of the member 4, it is withdrawn by means of the slot 7 in order to retain this right angle.

The high coefficient of friction between the web 2 and the cardboard prevents relative movement between the web and the fibres in the surface of the cardboard adjacent the web. Since the surface 5 is smooth whereas the cardboard contacting the web 2 is firmly held by friction, when the fold is made, the fibres in the cardboard on the inside of the fold 10 are crushed together, whilst the fibres on the outside of the fold are not stretched. The fold thus produced has the outer fibres unbroken and the strength of the cardboard is unimpaired.

Figure 5:
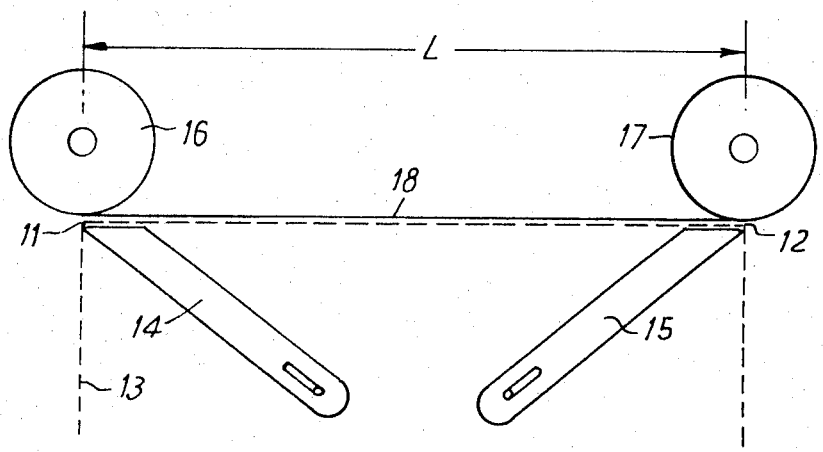
FIG. 5 shows, also schematically, a strip of cardboard being folded along two fold lines, by the method embodying the invention.

FIG. 5 shows schematically the features of a machine which can make two parallel folds in a cardboard sheet 13 simultaneously. Pressing elements 14, 15 hold the cardboard 13 against a common tensioned web 18 and cylinders 16, 17 (corresponding to the cylinder 8 of FIGS. 1 to 4) are movable so as to make folds 11,12 separated by a distance L.

Figure 6:
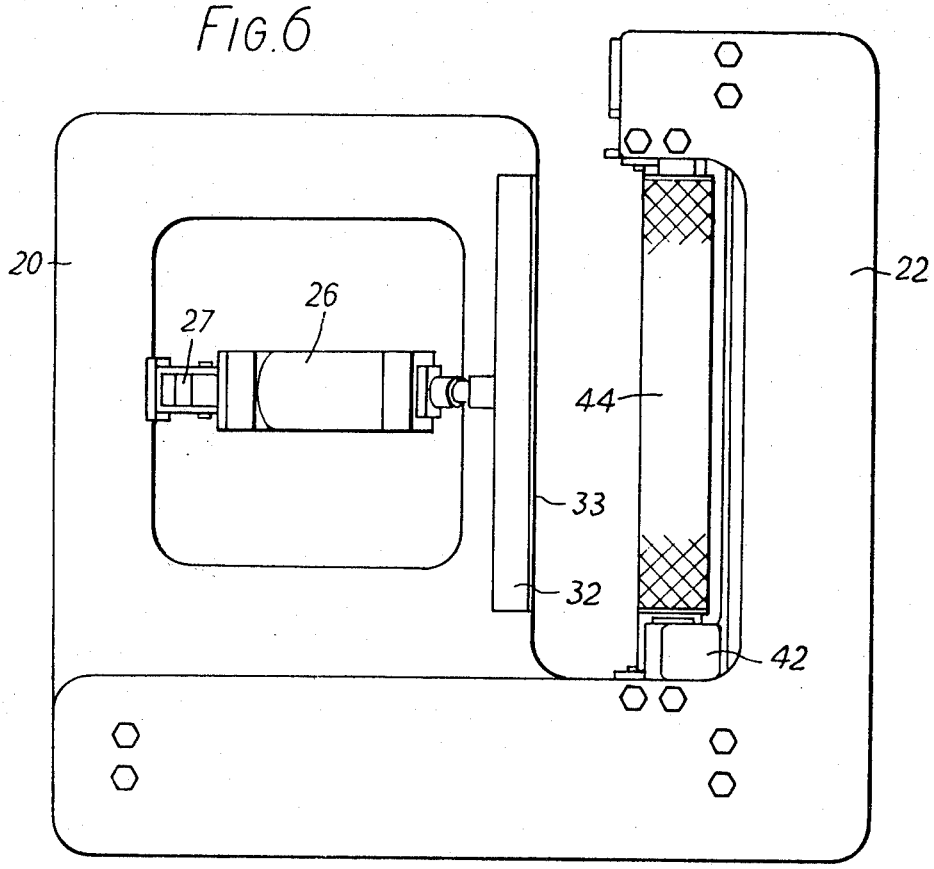
Figure 7:
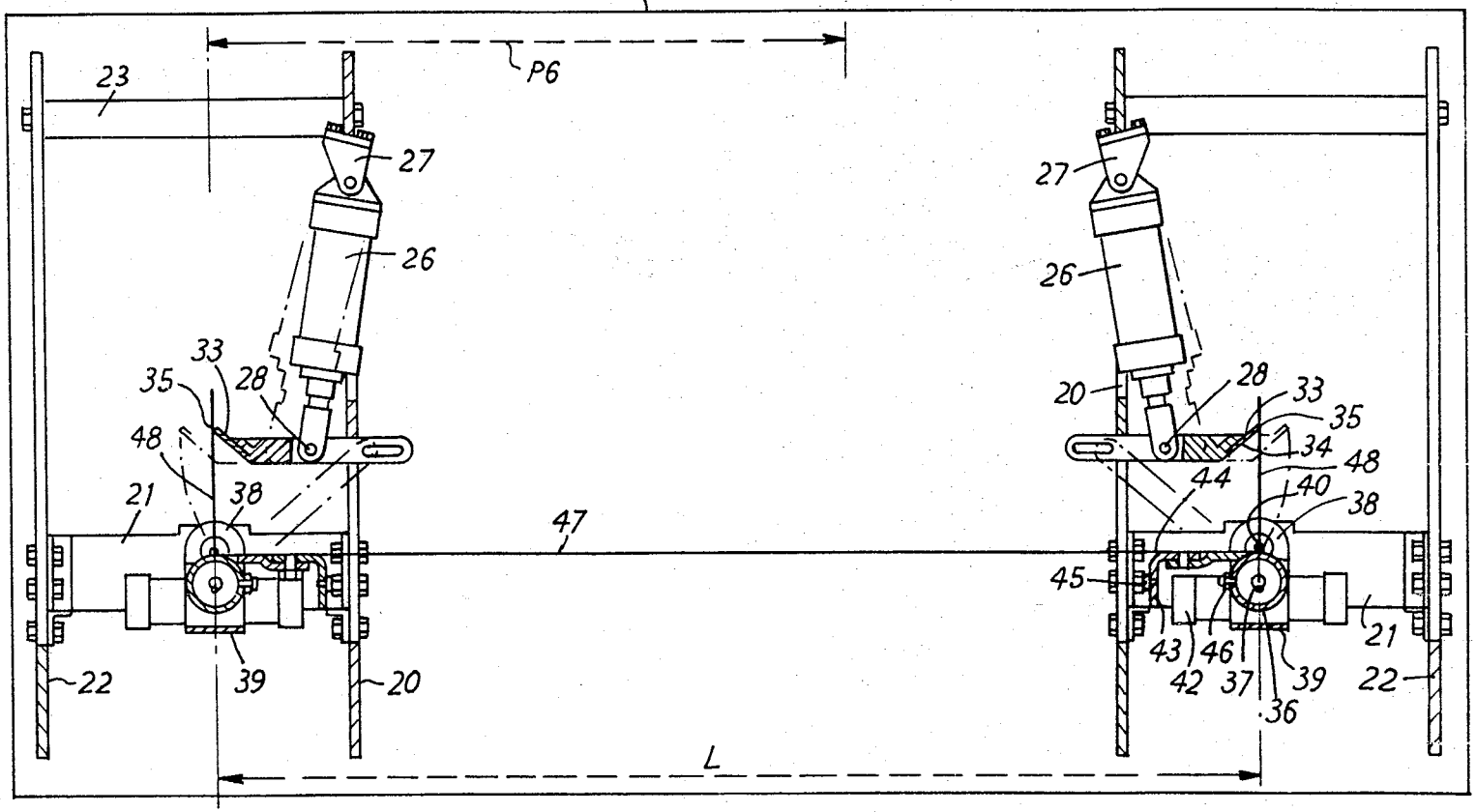
FIG. 7 shows a top view of the machine of FIG. 6 which can be seen to function according to the principle of FIG. 5.
Figure 8:
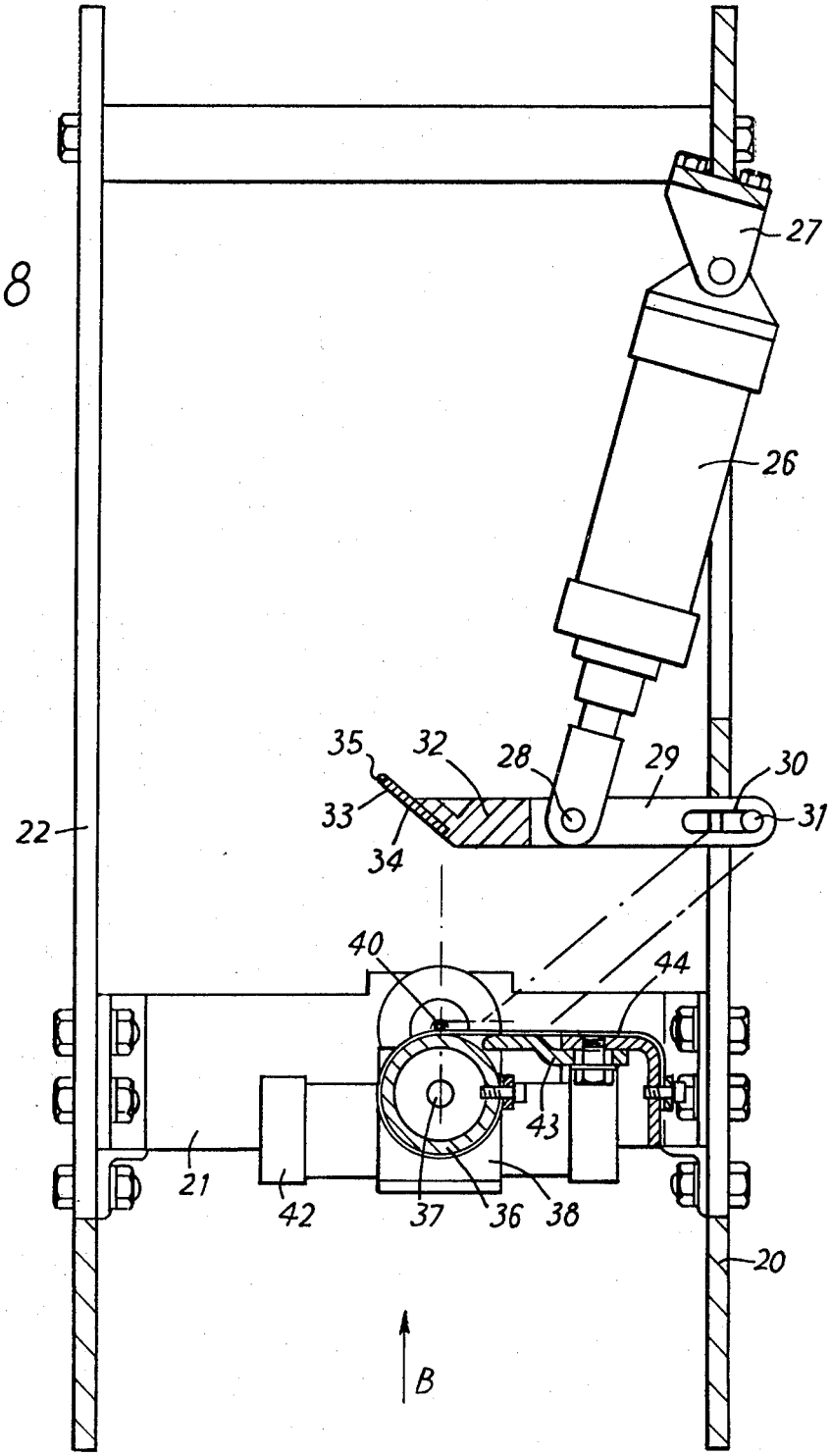
FIG. 8 is a sectional view in more detail on the line A—A of FIG. 9 of part of the machine of FIGS. 6 and 7.
Figure 9:
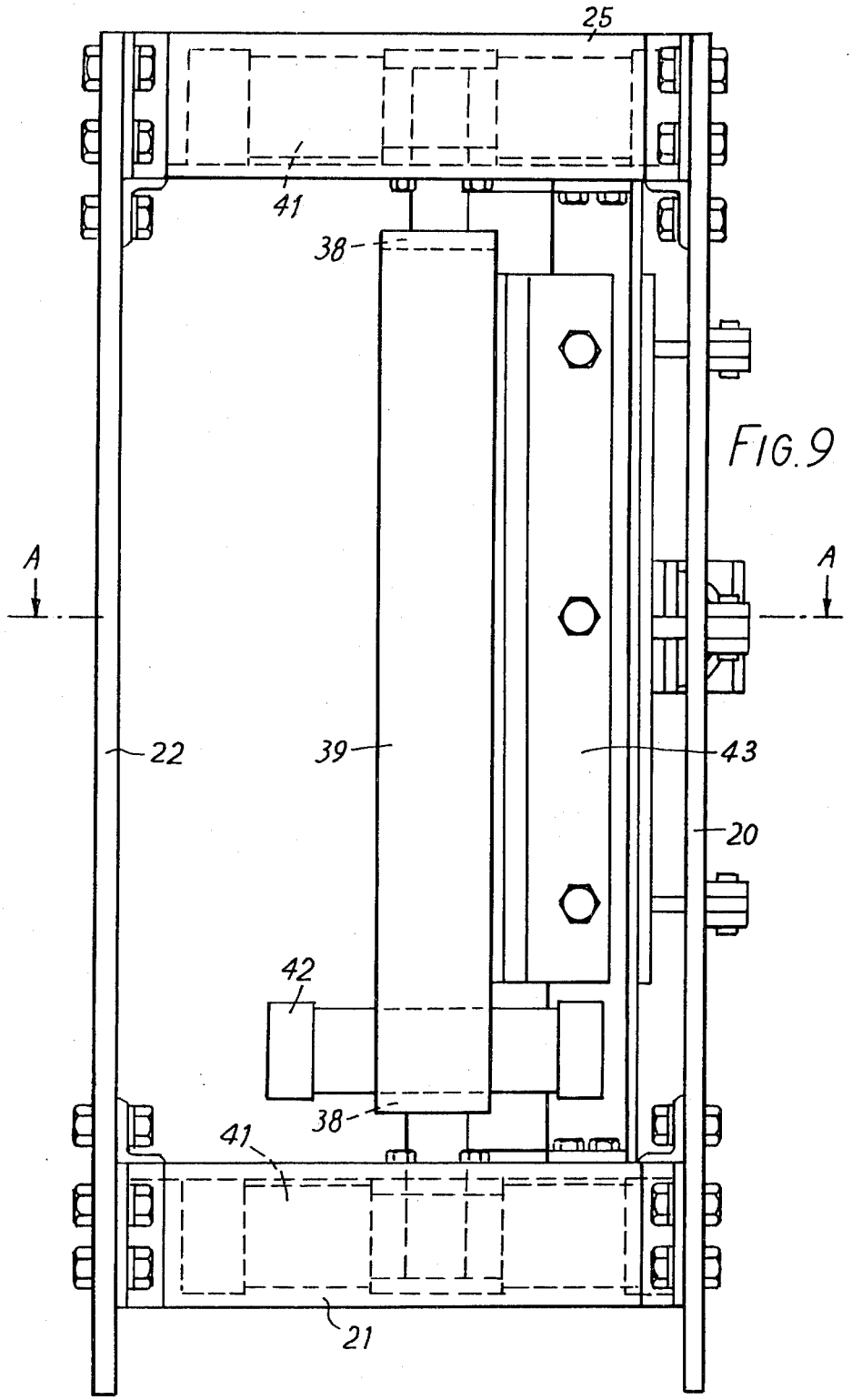
FIG. 9 is a side view in the direction of the arrow B of the parts shown in FIG. 8.

As FIG. 7 shows, the cardboard bending machine of FIGS. 6 to 9 has two mutually independent bending units arranged in the manner of the machine of FIG. 5 for forming two folds, simultaneously if desired, in a single sheet of cardboard which is placed in both units. The two units are mirror images of each other, about a central plane.

FIG. 6 shows the right-hand unit of FIG. 7 in side view from the right-hand side as seen in FIG. 7. The unit has a frame consisting of two parallel plates 20, 22 and cross-pieces 21, 23 at the lower end and a cross-piece 25 (FIG. 9) at the top. The frame plate 20 carries a pneumatic ram 26 on a hinged mounting 27. The piston of the ram 26 is attached at a pivot 28 to an arm 29 one end of which has a slot 30 which receives a pin 31 mounted on the frame plate 20. The other end of the arm 29 carries a member 32 which supports a blade 33 which forms the element which engages the cardboard and defines the fold line. This blade 33 is replaceably secured on the member 32, providing a planar face 34 and an edge 35.

Mounted between the cross-pieces 21,25 of the frame is a cylindrical roller 36, with its central axis 37 parallel to the said edge 35. At each axial end, the shaft of the roller 36 is rotatably mounted on a transverse plate 38. The two transverse plates 38 are connected by a plate 39 parallel to the roller 36, and the whole assembly of roller 36 and plates 38, 39 is mounted in the cross-pieces 21, 25 for rotation about an axis 40 parallel to the axis 37 and located at the circumference of the roller 36 and substantially at the location where the fold line is to be formed.

A pneumatic rotational drive device 41 is mounted in each cross-piece 21, 25 to drive the assembly 36, 38, 39 in rotation about the axis 40, and a similar, smaller drive device 42 mounted on the plates 38, 39 to drive the roller 36 in rotation about the axis 37 relative to the plates 38, 39. These drive devices 41, 42 are well-known and comprise opposed cylinders whose pistons carry racks which respectively mesh with opposite sides of a pinion. Operating the two cylinders together causes rotation of the pinion in one or other direction. The amount of rotation is of course limited.

An L-section plate assembly 43 is mounted on the frame and extends parallel to the roller 36. A web 44 of suitable fabric, e.g. canvas or plastics sheet having its surface towards the arm 29 patterned to roughen it (see FIG. 6), is stretched across the wide face of the L-section assembly 43 and around the roller 36, being secured at one edge by pins 45 to the narrow face of the assembly 43, and at the opposite edge by pins 46 to the surface of the roller 36. The drive device 42 can thus maintain the web 44 in tension by urging the roller 36 in rotation.

Operation of the machine is as follows:

A flat cardboard sheet is located with one surface against the two webs 44 in the plane indicated by line 47 of FIG. 7. The rams 26 are operated to push the faces 34 of the blades 33 against the other surface of the sheet. In this action, the arm 29 slides along the pin 31 so that the pin is at the outer end of the slot 30; this brings the edge 35 substantially to the axis 40 (see broken lines in FIGS. 7 and 8). The sheet is thus held against the tensioned web 44, which forms a backing surface. The drive devices 41 now operate to swing the roller 36 about the axis 40, so that the roller 36 folds the web 44 and the cardboard sheet around the blade edge 35 through an angle of more than 90°. A sharp fold line is thus formed in the sheet, with the web 44 gripping the cardboard surface at the outside of the fold so that the fibres there are not stretched to rupture, while at the inside of the fold the fibres are crushed together. The roller 36 is then retracted to its initial position, allowing the cardboard sheet to spring back to some extent. The ram 26 withdraws the arm 29, which first slides along the pin 31 to avoid pushing the cardboard back towards its flat condition (see the broken outlines of FIG. 7).

Simultaneously, the other bending unit forms a mirror-image fold in the cardboard sheet, so that the sheet assumes the flat U-shape shown by lines 47,48 of FIG. 7.

The distance L (FIG. 7) between the two units is preferably adjustable, to vary the spacing of the two folds.

What I claim and desire to secure by Letters Patent is:

1. Method of folding a sheet of cardboard along a straight fold line, comprising the steps of (a) locating a first surface of said sheet, having a given dimension, against a first element having a straight edge of at least equal dimension to that of said sheet dimension which defines the fold line, (b) locating an opposite surface of said sheet against a support surface having a dimension at least equal to said sheet dimension in the form of a tensioned flexible web which makes high-friction engagement with the cardboard sheet, and (c) moving a second element having a dimension at least equal to said sheet dimension relative to said first element in a curved path about said straight edge so as to simultaneously engage and force said flexible web and said cardboard sheet adjacent the said edge of the first element to bend same around said edge, thereby folding the sheet and the web around the said edge to form the fold line in the sheet.

2. Method according to claim 1, wherein the said web under tension has a planar position against which a part of the cardboard sheet adjacent the fold line is pressed by the said first element during folding.

3. Method according to claim 1, wherein said second element is a roller around which the said web is wrapped and which is urged in rotation about its central axis, which is parallel to and spaced from the fold line so as to tension the web.

4. Method according to claim 3, wherein the movement of said roller is constituted of a rotation about a second axis which lies substantially at its circumference and substantially at the fold line.

5. An apparatus for folding a sheet of cardboard along a straight fold line, comprising a first element having a straight edge adapted to define the fold line, a support surface for the cardboard sheet and a second element movable in a path close to said straight edge of the first element to fold a cardboard sheet located between the first element and the support surface around the said straight edge in order to form the fold line in the cardboard sheet, the improvement that said support surface is provided by a flexible web maintained under tension and lying between said second element and said first element, means for moving said second element in a curved path about said straight edge to engage said web and simultaneously bend said web around said edge of the first element together with the cardboard sheet, the surface of said web which engages the cardboard having a high coefficient of friction with respect to said cardboard.

6. Apparatus according to claim 5, wherein said second element is a cylindrical roller rotatable about its central axis, which is parallel to and spaced from said edge of the first element when said first element is in contact with said cardboard, the said web being wrapped around and secured to said roller and being tensioned by means urging said roller in rotation about said central axis.

7. Apparatus according to claim 6, wherein said roller is also rotatable about a second axis which is parallel to said central axis and substantially coincident with the roller circumference and with said edge of the first element when the latter is in contact with said cardboard rotation of the roller about said second axis causing the folding of the sheet.

8. Apparatus for folding a sheet of cardboard along a straight fold line, comprising (a) a first element having an operative position, a straight edge adapted to define the fold line in the cardboard sheet and a planar surface adjacent said edge, (b) a flexible web, having first and second surfaces, the first surface having a high coefficient of friction relative to cardboard, (c) means adapted to maintain said flexible web under tension, said web extending over a portion of said means, in a planar condition with said first surface at said portion lying parallel to and closely spaced from said planar surface of the first element in the operative position of the first element, (d) means to move a second element relative to the said edge of the first element in a curved path about said straight edge to push said second surface of the flexible web in a manner such that said first surface of said web, and also a cardboard sheet placed between the said first surface of the web and the first element, are folded around the said edge of the first element.

9. Apparatus according to claim 8, wherein said second element is a cylindrical roller rotatable about a first axis which is parallel to the said edge and to its cylindrical axis and about a second axis parallel to the first axis and substantially coincident with the cylindrical surface of the roller and with the said edge, the flexible web being wrapped around and secured to the roller and the said tension-maintaining means urging the roller in rotation about said first axis so as to tension the web.

* * * * *